US005714266A

United States Patent [19]

Harrison et al.

[11] Patent Number: 5,714,266

[45] Date of Patent: Feb. 3, 1998

[54] FLUORINE-CONTAINING PHOSPHATES

[75] Inventors: Susan S. Harrison, Minneapolis; Karlan B. Hunt, Champlin, both of Minn.

[73] Assignee: Minnesota Mining and Manufacturing Company, St. Paul, Minn.

[21] Appl. No.: 662,558

[22] Filed: Jun. 13, 1996

Related U.S. Application Data

[63] Continuation of Ser. No. 245,014, May 18, 1994.

[51] Int. Cl.[6] ..... B32B 27/00; C09D 5/16

[52] U.S. Cl. ..... 428/425.1; 558/175; 252/355; 106/18.14; 528/391; 528/398; 528/401; 428/357; 428/425.1

[58] Field of Search ..... 558/175; 252/355; 106/18.14; 528/391, 398, 401; 428/357, 425.1

[56] References Cited

U.S. PATENT DOCUMENTS

| | | | |
|---|---|---|---|
| 3,083,224 | 3/1963 | Brace et al. | 558/204 |
| 3,094,547 | 6/1963 | Heine | 558/175 |
| 3,096,207 | 7/1963 | Cohen | 427/384 |
| 3,112,241 | 11/1963 | Mackenzie | 162/164.6 |
| 3,188,340 | 6/1965 | Mackenzie et al. | 558/170 |
| 4,419,298 | 12/1983 | Falk et al. | 260/501.16 |
| 4,426,466 | 1/1984 | Schwartz | 523/455 |
| 4,536,254 | 8/1985 | Falk et al. | 162/135 |
| 5,252,754 | 10/1993 | Bottorff | 549/328 |

FOREIGN PATENT DOCUMENTS

| | | |
|---|---|---|
| 2073610 | 1/1993 | Canada . |
| 56-109343 | 8/1981 | Japan . |
| 60-006501 | 2/1985 | Japan . |
| 2258250 | 2/1993 | United Kingdom . |
| WO92/18694 | 10/1992 | WIPO . |
| WO94/04753 | 3/1994 | WIPO . |

OTHER PUBLICATIONS

B.M. Moyers, Diagnostic Sizing Loss Problem Solving and Alkaline Systems, pp. 425–432.

A.R. Colasurdo & I. Thorn, The Interactions of Alkyl Ketene Dimer with Other Wet-end Additives, Sep. 1992, TAPPI Journal, pp.143–149.

P.A. Patton, On the Mechanism of AKD Sizing and Size Reversion, 1991 Papermakers Conference, pp. 415–423.

*Primary Examiner*—Samuel A. Acquah

*Attorney, Agent, or Firm*—John A. Fortkort

[57] ABSTRACT

Compositions for treating pulp slurry in the wet end comprising (A) a mixture of fluoroaliphatic radical-containing phosphate esters comprising at least 70% of a phosphate monoester, e.g., $C_8F_{17}SO_2N(C_2H_5)C_2H_4OP(O)(OH)(O^-NH_4^+)$ and (B) an alkyl ketene dimer are disclosed. Methods for using such compositions and the resulting treated products are also disclosed.

21 Claims, No Drawings

FLUORINE-CONTAINING PHOSPHATES

This is a continuation of application Ser. No. 08/245,014 filed May 18, 1994.

FIELD OF INVENTION

This invention relates to fluorine-containing phosphates and their preparation and use. In another aspect, this invention relates to methods for treating paper or paperboard and the resulting treated paper or paperboard.

BACKGROUND

Paper and paperboard substrates have wide utility. It is often necessary to treat the paper or paperboard in order to impart improved properties to the paper or paperboard. For example, it is often desired to improve the oil and water repellency of the paper or paperboard.

U.S. Pat. No. 3,094,547 (Heine) describes phosphorus-containing fluorocarbon compounds of the formula $[R_fSO_2N(R)R'O]_mP(O)X_{(3-m)}$. These materials are said to be useful (either as simple compounds or made into polymers) for (1) sizing fabrics to impart both repellency to water, and resistance to absorption and soiling by oily and greasy materials, (2) coating and impregnating matrices such as paper and leather, (3) providing certain desirable surfactant properties in polishes and plating baths, and (4) imparting corrosion resistance.

U.S. Pat. Nos. 4,536,254 and 4,419,298 (Falk), describe ammonium and amine salts of mono- and di-carboxylic acids having the formula $(R_f—R_1—X)_2C(R_2)—B—COO^-Z^+$. These salts, applied in the form of aqueous dispersions or emulsions, are said to be useful in rendering cellulosic and natural and synthetic polyamide materials oil and water repellent. Alkyl ketene dimers are recommended for incorporation as sizing agents. U.S. Pat. Nos. 3,083,224 (Brace et al.), 3,096,207 (Cohen), 3,112,241 (Mackensie), and 3,188,340 (Mackensie) describe the use of various fluorochemical phosphates as repellent treatments.

The use of certain fluorinated aldoketene dimers as a combination oil and water resistant size for cellulosic materials is described by Bottorff in U.S. Pat. No. 5,252,754.

An example of a commercially available product for increasing the oil repellency of paper and paper board products is Scotchban™ Brand Paper Protector FC-807 from 3M Company. Scotchban™ Brand Paper Protector FC-807 is primarily a mixture of phosphate esters.

Another example of a commercially available product for increasing the oil repellency of paper and paper board is Lodyne™ Paper Protector P201E from Ciba-Geigy.

Commercially available products for increasing the oil repellency of paper and paper board are sometimes blended with an alkyl ketene dimer in order to improve water repellency. However, sizing performance of alkyl ketene dimers ("AKD") can be adversely affected by various additives. At the TAPPI proceedings of the 1991 Papermakers Conference ("Diagnostic Sizing Loss Problem Solving in Alkaline Systems," 425–432), B. M. Moyers presented a paper on the subject of contamination of AKD by surface active agents, claiming that if added either at the wet end or in the pulp mill, these agents will have a negative effect on sizing. Others have written about adverse effects of various wet-end additives on AKD performance and loss of sizing with time (A. R. Colasurdo and I. Thorn, "The Interactions of Alkyl Ketene Dimer with Other Wet-end Additives", September 1992 TAPPI Journal, 143–149; P. A. Patton, "On the Mechanism of AKD Sizing and Size Reversion," 1991 Papermakers Conference, 415–423).

BRIEF SUMMARY OF THE INVENTION

Briefly, in one aspect, the present invention provides a composition for treating pulp slurry in the wet end comprising (A) a mixture of fluoroaliphatic radical-containing phosphate esters comprising at least 70% of phosphate monoesters, e.g., $C_8F_{17}SO_2N(C_2H_5)C_2H_4OP(O)(OH)(O^-NH_4^+)$ and (B) an alkyl ketene dimer, e.g., Hercon™ 76 from Hercules. Preferably, said mixture of esters comprises greater than 90% of said monoester.

In another aspect, this invention provides a method for preparing treated paper and paperboard products comprising (1) treating pulp slurry in the wet end with the composition of this invention, and (2) curing this treated slurry using low heat conditions (e.g. ambient temperature up to 250° F.) and high moisture content (e.g. greater than 10%) to give a treated paper or paperboard.

In another aspect, this invention provides the resulting treated paper or paperboard.

This invention provides treated paper and paperboard exhibiting superior resistance to both microwave soups and oils within two hours of drying. This unexpected behavior is most dramatic with pulp slurries containing a high level of post-consumer waste and/or fines, as these slurries typically are more difficult to treat than virgin fiber to achieve resistance to soups and oils. This invention gives an unexpected boost in water sizing performance compared to when the alkyl ketene dimer is used alone, especially in making molded pulp items such as microwave trays, take-out food trays and egg cartons. These items are made from very diverse furnish types (i.e. blends of softwood and hardwood fibers along with clay fillers and binders), may contain up to 100% recycled fiber, and are generally incompletely dried during the cure cycle.

DETAILED DESCRIPTION

Fluoroaliphatic radical-containing phosphate monoesters useful in this invention can be represented by the general Formula:

$$R_f—Q—O—P(O)(O^-M^+)O^-M^+) \quad (I)$$

where $R_f$ is a fluoroaliphatic radical, Q is a divalent linking group, and each M is independently a monofunctional cation.

The fluoroaliphatic radical, $R_f$, is a stable, inert, preferably saturated, non-polar, monovalent aliphatic radical. It can be straight chain, branched chain, or cyclic, or combinations thereof. It can contain catenary heteroatoms, bonded only to carbon atoms, such as oxygen, divalent or hexavalent sulfur, or nitrogen. $R_f$ is preferably a fully fluorinated radical, but hydrogen and chlorine atoms can be present as substituents provided that not more than one atom of either is present for every two carbon atoms. The $R_f$ radical has at least 3 carbon atoms, preferably 6 to 12 carbon atoms, and most preferably, 8 to 10 carbon atoms, and preferably contains about 40% to about 78% fluorine by weight, more preferably about 50% to about 78% fluorine by weight. The terminal portion of the $R_f$ radical is a perfluorinated moiety which will preferably contain at least 7 fluorine atoms, e.g. $CF_3CF_2CF_2$—, $(CF_3)_2CF$—, $SF_5CF_2$—, or the like.

The divalent linking group, Q, is a divalent organic linking group, which provides a means to link $R_f$ with the phosphate. The linking group, Q, can have a wide variety of structures, for example, alkylene (e.g., ethylene), cycloalkylene (e.g., cyclohexylene), aromatic (e.g., phenylene), and combinations thereof (e.g. xylylene). The linking group, Q, can comprise a hetero atom-containing group, e.g., —O—, —S—, —C(O)—, —N(R)—, —C(O)N(R)—, —$SO_2$N(R)—, —$OC_2H_4$—, or combinations thereof, where R is alkyl. The linking group, Q, can be combinations of the above mentioned groups, e.g., alkylenesulfonamido, sulfonamidoalkylene, carbonamidoalkylene, oxydialkylene (e.g., —$C_2H_4OC_2H_4$—), alkylenecarbamato and the like.

The monofunctional cation, $M^+$, is a monofunctional cation, such as $H^+$, $Li^+$, $Na^+$, $K^+$, or $R'_4N^+$, where each R' is independently a hydrogen or an alkyl including substituted alkyl such as —$C_2H_4OH$.

Alkyl ketene dimers useful in this invention include those where the alkyl group is straight chain or branched, contains between 6 and 23 carbon atoms, and may be saturated (e.g., palmitic, stearic, and myristic ketene dimers) or unsaturated (e.g. oleic ketene dimer), or mixtures thereof.

The compositions of this invention may also include other additives, for example a cationic retention aid.

EXAMPLES

In the following Examples and Comparative Examples, various compositions were prepared and used to treat various paper pulps. The treated paper pulps were then tested using the Soup Test and the Oil Test described below.

The following Examples and Comparative Examples illustrate the utility of this invention for preparing treated paper for microwave food containers, and its performance advantages over the existing art.

Soup Test

A boat was made by taking a 12.7 cm by 12.7 cm square of the treated paper and folding a 1.3 cm to 1.9 cm strip parallel to and along each of the four sides. The corners were then folded over and stapled to give a square boat 8.1 cm to 10.2 cm across with a depth of approximately 1.3 cm to 1.9 cm. The empty boat was then weighed (initial weight).

A 750W microwave oven (Sears Kenmore™ brand) was preheated by placing a one liter Nalgene™ beaker filled with water on the glass tray and heating this container of water on high setting for 5 minutes. Following this preheating step, the beaker of water was removed, and a Rubbermaid™ microwave tray was placed on the glass plate to prevent hot spots.

Approximately 70 ml of Campbell's™ vegetable beef soup was added to the above-constructed paper boat. The soup-filled boat was then covered by Saran™ wrap, placed on the ventilated rack in the preheated microwave oven, and cooked for 45 seconds using 75% of full power, achieving a final soup temperature of a approximately 180° to 190° F. The sample was then removed from the oven and placed on a counter top. After 6 minutes of cooling time, the soup was removed and the corners of the boat torn to give a flat sample.

The soup-soaked boat was then blotted between two sheets of paper towel, and reweighed. The final or soaked weight was recorded, and the amount of soup absorbed into the treated paper was calculated using the formula: % weight gain =[(soaked weight-initial weight)/initial weight]×100. The less soup absorbed is considered more desirable.

The percent of boat bottom surface stained after the microwave test was estimated visually.

Oil Test

A boat was made as in the soup test.

A 900W microwave (Sharp Carousel™ II) was preheated by placing a one liter Nalgene™ beaker filled with water on the turntable and heating this container of water on high for 5 minutes. Following this preheating step the water was removed and a microwave tray (Rubbermaid) was placed on the glass plate to prevent hot spots.

A 50 ml Nalgene™ beaker was filled to approximately 60 ml with Crisco™ vegetable oil. The oil was then placed in the boat and the boat was placed in the preheated microwave oven and heated on high for one minute to reach a final temperature of 200° F.

The boat was then removed from the oven and placed on a counter top for five minutes. At the end of this time the percent of the bottom of the boat that was stained was visually estimated. Less staining is generally desirable.

Another rating, "creases", was assigned when oil staining was noted at the crease lines in the boat and nowhere else. "Creases" is considered to be between no staining (0%) and 25% staining of the boat bottom in desirability.

Example 1

Into a 1-L 3-necked round bottom flask equipped with stirrer, Thermowatch™ temperature control device available from $I^2R$, and water-condenser was added 251 g (0.5 mole) of $C_8F_{17}SO_2F$. The sulfonyl fluoride was heated with stirring while 54 g (1.2 mole) of $C_2H_5NH_2$ from a gas cylinder was bubbled in over a 1.5 hour period. The contents in the flask, which had reached 90° C., turned red and thickened. The contents were heated for an additional 2 hours at 90° C. to complete the amidation reaction. First, a 200 mL deionized-water wash was added to remove residual amine. Then 200 mL of 5% aqueous $H_2SO_4$ was added to the flask to wash the ionic impurities from the fluorochemical amide. After washing for several minutes, the aqueous acid phase was removed by suction. The washing and aqueous phase removal process was repeated twice more using 200 mL aliquots of deionized water. The residual water was removed from the amide by stripping at 90° C. and 380 torr for 30 minutes. Yield of the washed fluorochemical amide, $C_8F_{17}SO_2N(C_2H_5)H$, was quantitative at 263.5 g (0.5 mole). The 1-L flask containing the $C_8F_{17}SO_2N(C_2H_5)H$ still at 90° C., was then equipped with stirrer, Thermowatch™ temperature control device available from $I^2R$, and addition funnel. 13.2 g of $Na_2CO_3$ was added as a pulverized powder, causing an exotherm to 100° C. Using the addition funnel, 52.8 g (0.6 mole) of warm (melted) ethylene carbonate was added over a 30 minute period. The composition in the flask exothermed to 115° C. as $CO_2$ started to evolve at a rapid rate (monitored using a bubbler attached to the exit of the condenser). The flask was heated to 135° C. with the $CO_2$ evolution rate becoming vigorous. The reaction was allowed to proceed for 5 more hours at 135° C. until no more $CO_2$ evolution was noted. Then, after reducing the flask temperature to 85°–90° C., the crude product in the flask was washed with 200 mL of deionized water, followed by a washing with 200 mL of 5% aqueous $H_2SO_4$, followed by three more washings with 200 mL aliquots of deionized water. After each washing, the aqueous phase was removed by suction. Keeping the temperature at 85°–90° C., residual water was stripped off at 250 torr for 30 minutes. Next, the equipment was rearranged for a single pass open air cooled condenser for vacuum distilation at a pressure of 2 mm Hg and at 135°to 145° C. 234 g of $C_8F_{17}SO_2N(C_2H_5)C_2H_4OH$, the desired product, was collected, representing a yield of 82%.

Into a 500 mL round-bottom three-neck flask with thermometer, stirrer and reflux condenser was charged 57.1 g (0.1 mole) of $C_8F_{17}SO_2N(C_2H_5)C_2H_4OH$, 57.1 g of diisopropyl ether, and 11.4 g of polyphosphoric acid. A slight exotherm of several ° C. was noted upon mixing of ingredients. The mixture was heated for two hours at 70° C. and then was allowed to stand for 3 days at room temperature. After standing, the mixture was homogeneous, clear and light yellow in color. The mixture was heated to 35° C. and 2.5 g of $P_2O_5$ was added, forming a cloudy solution. Additional heat was added to bring the mixture to 69° C., which was the reflux temperature of the ether. The mixture was refluxed for 4 hours, whereupon the mixture formed a deep yellow clear solution. The mixture was refluxed an additional 2 hours the next day. After cooling again to about 22° C., 50 mL of deionized water was added, causing an exotherm to 28° C. The mixture turned cloudy and thickened. After adding another 50 mL of water, suspended solids resulted. 10 g of concentrated HCl was added, which caused separation into a light yellow top phase and aqueous bottom phase. Another 50 mL of water, 5 g of concentrated HCl and 25 mL of ether was added, which caused a further separation into three distinct phases.

The bottom two phases, containing the desired product, were isolated from the product-poor top ether phase, transferred to a reaction flask, and washed with a mixture of 100 mL deionized water and 10 g concentrated hydrochloric acid, which caused the formation of two phases. The contents of the reaction flask were then transferred to a separatory funnel, the bottom phase was saved and returned to the reaction flask, and the top phase was discarded. The bottom phase was washed two more times using the same above mentioned procedure with water and HCl. A small sample of the free-acid containing bottom phase was dried. The free acid was converted to the methyl ester by reacting with diazomethane, and was analyzed for conversion to fluoroalkyl mono- and di-ester using gas-liquid chromatography ("glc") with flame ionization. According to this analysis, yield of the ester mixture was 73%, of which 96.6% was the desired monoester, $C_8F_{17}SO_2N(C_2H_5)C_2H_4OP(O)(OH)_2$, and 2.84% was diester, $[C_8F_{17}SO_2N(C_2H_5)C_2H_4O]_2P(O)(OH)$.

To a clean flask was added the thrice-washed free acid-containing bottom phase recovered from the separatory funnel, 23.3 g (0.2 mole) of 28% aqueous $NH_4OH$ and 114 g of deionized water. The flask was stirred and heated to 50° C. Initially, the mixture became stringy but, after a few minutes, thinned out into a white stable emulsion comprising the salt $C_8F_{17}SO_2N(C_2H_5)C_2H_4OP(O)(O^-)_2(H_4N^+)_2$. Percent solids as determined by oven drying was 20.0% (average of 3 values).

The fluoroaliphatic phosphate monoester diammonium salt was then evaluated as a paper treatment. The monoester, Nalco™ 7607 cationic retention aid, and Hercon™ 76 alkyl ketene dimer were each diluted 10 times with deionized water. The desired amount of diluted Nalco™ 7607 was then added to a slurry of bleached virgin Kraft wood pulp, 50% hardwood, 50% softwood, refined to 650 CSF (available from Georgia Pacific), hereinafter referred to as "50—50", at approximately 3% consistency. After 20 seconds, the diluted Hercon™ 76 was added and then after 20 more seconds, the diluted fluoroaliphatic monoester was added. This blend was mixed for one minute, then was formed into a handsheet using a 30.5 cm by 30.5 cm Williams™ Sheet Mold. The resulting wet sheet was peeled off the mold, was pressed at 2000 psi, and was dried using a Johnke™ Drum Drier set at 250° F. until reaching a residual moisture content of 10–15% by weight. The composition of Example 1 is summarized in Table 1.

The resulting treated paper was tested using the Soup Test and Oil Test described above, 24 hours after treatment and 1 week after treatment. The test results are summarized in Table 2.

Examples 2–4

In Examples 2–4, compositions were prepared and used to treat paper as in Example 1 except that the amounts of the components were varied to give the % solids on fabric (% SOF) shown in Table 1 and different paper pulps were treated. Example 2 was used to treat 100% recycled furnish news stock (available from Waldorf Corporation) that was repulped in a Waring™ blender, hereinafter referred to as "News". Example 3 was used to treat a pulp of 50% post consumer waste, 25% hardwood, 25% softwood (available from Ponderosa Group, Inc.), hereinafter referred to as "Group". Also, Example 4 varied in that the drying at 250° F. was allowed to proceed to give approximately 5% residual moisture content. The composition of Examples 2–4 is summarized in Table 1.

Examples 2–4 were tested as in Example 1. The results are summarized in Table 2.

Comparative Examples C1–C4

In Comparative Examples C1–C4, compositions were prepared and used to treat paper as in Examples 1–4 except that instead of the ester mixture of Example 1, which is predominately monoester, Scotchban™ Brand Paper Protector FC-807 was used. Scotchban™ Paper Protector FC-807 is a mixture of esters which generally comprises greater than 82% of the diester $[C_8F_{17}SO_2N(C_2H_5)C_2H_4O]_2P(O)(O^-NH_4^+)$, less than 15% of the monoester $[C_8F_{17}SO_2N(C_2H_5)C_2H_4O]P(O)(O^-NH_4^+)_2$, and less than 3% of the triester $[C_8F_{17}SO_2N(C_2H_5)C_2H_4O]_3P(O)$. The predominantly monoester composition used in Example 1 is identified in Table 1 as "Monoester." The predominantly diester composition of Scotchban™ Paper Protector FC-807 is identified in Table 1 as "Diester." The amount of the components was varied to give the % SOF shown in Table 1. Also, Comparative Example C4 varied in that the drying was allowed to proceed to give approximately 5% residual moisture content. The particular paper pulp is also shown in Table 1.

Comparative Examples C1–C4 were tested as in Example 1. The test results are summarized in Table 2.

Comparative Examples C5–C7

In Comparative Examples C5–C7, compositions were prepared and used to treat paper as in Examples 1–4 except that no fluoroaliphatic ester mixture was used. The amount of the components was varied to give the % SOF shown in Table 1. The particular paper pulp is also shown in Table 1.

Comparative Examples C5–C7 were tested as in Example 1. The test results are summarized in Table 2.

TABLE 1

| Ex. | Nalco 7607 % SOF | Hercon 76 % SOF | Fluorochemical % SOF | Fluorochemical Type | Pulp | Moisture |
|---|---|---|---|---|---|---|
| 1 | 0.4 | 0.5 | 0.17 | Monoester | 50–50 | 10–15% |
| C1 | 0.4 | 1.0 | 0.17 | Diester | | |
| C5 | 0.4 | 0.5 | 0 | None | | |
| 2 | 0.4 | 3 | 0.51 | Monoester | News | 10–15% |
| C2 | 0.4 | 3 | 0.51 | Diester | | |
| C6 | 0.4 | 3 | 0 | None | | |
| 3 | 0.4 | 0.5 | 0.17 | Monoester | Group | 10–15% |
| C3 | 0.4 | 1.0 | 0.17 | Diester | | 5% |
| C7 | 0.4 | 0.5 | 0 | None | | |
| 4 | 0.4 | 0.5 | 0.17 | Monoester | | |
| C4 | 0.4 | 1.0 | 0.17 | Diester | | |

TABLE 2

| | Soup Test | | | | Oil Test | |
|---|---|---|---|---|---|---|
| | 24 Hours | | 1 Week | | | |
| Ex. | Weight Gain | Visual | Weight Gain | Visual | 24 Hours Visual | 1 Week Visual |
| 1 | 30% | 0+% | 28% | 0+% | 0% | 0% |
| C1 | 39% | 25% | >100% | 0–25% | 0% | 0% |
| C5 | 30% | 0% | 26% | 0% | 100% | 100% |
| 2 | 53% | 0% | 45% | 0% | 0% | 0% |
| C2 | 159% | 100% | 157% | 100% | 0% | 0% |
| C6 | 26% | 0% | 27% | 0% | 100% | 100% |
| 3 | 47% | 0+% | 41% | 0% | 0% | 0% |
| C3 | 132% | 100% | 100–200% | 100% | 0% | 0% |
| C7 | 105% | 50–75% | 106% | 75–100% | 100% | 100% |
| 4 | 38% | 0% | 44% | 0+% | 0% | 0% |
| C4 | 129% | 100% | 124% | 100% | 0% | 0% |

The data in Table 2 show that with a variety of pulp types, the compositions of Examples 1–4, which contained the mixture of predominately monoester, gave superior performance in the Soup Test compared to the Comparative Examples C1–C4, which contained the mixture of predominately diester. Comparative Examples C5–C7, which contained no fluoroaliphatic esters, showed poor oil holdout.

Examples 5–8

In Examples 5–8, compositions containing fluoroaliphatic monophosphate ester were prepared, used to treat paper, and tested as in Examples 1–4. The compositions and the pulp treated are summarized in Table 3. All paper pulps were dried to 10–15% residual moisture content by weight except for Example 8 which was dried to about 5% residual moisture content by weight. Test results are summarized in Table 4.

Comparative Examples C8–C11

In Comparative Examples C8–C11, compositions were prepared and used to treat paper as in Examples 1–4 except that instead of the ester mixture of Example 1, which is predominately monoester, Lodyne™ P201E paper treatment, a difluoroalkyl carboxylate, available from Ciba-Geigy was used. The compositions and the pulp treated are summarized in Table 3. All paper pulps were dried to 10–15% residual moisture content by weight except Comparative Example C11 which was dried to about 5% residual moisture content by weight.

Comparative Examples C8–C11 were tested as in Example 1. The test results are summarized in Table 4.

TABLE 3

| Ex. | Nalco 7607 % SOF | Hercon 76 % SOF | Fluorochemical % SOF | Fluorochemical Type | Pulp | Moisture |
|---|---|---|---|---|---|---|
| 5 | 0.4 | 0.5 | 0.17 | Monoester | 50–50 | 10–15% |
| C8 | 0.4 | 0.5 | 0.17 | Lodyne ™ P201E | | |
| 6 | 0.4 | 0.5 | 0.51 | Monoester | News | 10–15% |
| C9 | 0.4 | 0.5 | 0.51 | Lodyne ™ P201E | | |
| 7 | 0.4 | 0.5 | 0.17 | Monoester | Group | 10–15% |
| C10 | 0.4 | 0.5 | 0.17 | Lodyne ™ P201E | | 5% |
| 8 | 0.4 | 0.5 | 0.17 | Monoester | | |
| C11 | 0.4 | 0.5 | 0.17 | Lodyne ™ P201E | | |

TABLE 4

| | Soup Test | | | | Oil Test | |
|---|---|---|---|---|---|---|
| | 24 Hours | | 1 Week | | | |
| Ex. | Weight Gain | Visual | Weight Gain | Visual | 24 Hours Visual | 1 Week Visual |
| 5 | 30% | 0+% | 28% | 0+% | 0% | 0% |
| C8 | 26% | 0+% | 26% | 0% | creases | creases |
| 6 | 53% | 0% | 45% | 0% | 0% | 0% |
| C9 | 26% | 0% | 20% | 0% | 0% | creases |
| 7 | 47% | 0+% | 41% | 0% | 0% | 0% |
| C10 | 116% | 100% | 86% | 75–100% | 0% | 0% |
| 8 | 39% | 0% | 42% | 0+% | 0% | 0% |
| C11 | 39% | 0+% | 42% | 0+% | 0% | 0% |

The data in Table 4 show that the compositions of Examples 5–8, which contained the mixture of predominately fluoroalkyl monophosphate ester, gave overall superior Soup and Oil Test performance compared to the compositions of Comparative Examples C8–C11, which contained Lodyne™ P201E paper treatment, a difluoroalkyl carboxylate.

Examples 9 and 10

In Examples 9 and 10, compositions were prepared, used to treat paper, and tested as in Examples 1–4, except that the Soup Test performance was evaluated 2 hours after treatment and the Oil Test performance was evaluated 24 hours after treatment. Also, the compositions were used to treat 100% milk carton stock clippings, with polyethylene coating removed, available from Keyes Albertville, hereinafter referred to as "Keyes". Drying was done at 250° F. to give 10–15% residual moisture content. The compositions and pulp are summarized in Table 5. The test results are summarized in Table 6.

Comparative Examples C12 and C13

In Comparative Examples C12 and C13, compositions containing Lodyne™ P201E paper treatment were prepared, used to treat paper pulp, and tested as in Examples 9 and 10. The compositions and pulp are summarized in Table 5. Test results are summarized in Table 6.

TABLE 5

| | Nalco 7607 | Hercon 76 | Fluorochemical: | | |
|---|---|---|---|---|---|
| Ex. | % SOF | % SOF | % SOF | Type | Pulp |
| 9 | 0.4 | 0.5 | 0.17 | Monoester | Keyes |
| 10 | 0.4 | 0.5 | 0.24 | Monoester | |
| C12 | 0.4 | 0.5 | 0.17 | Lodyne ™ P201E | |
| C13 | 0.4 | 0.5 | 0.24 | Lodyne ™ P201E | |

TABLE 6

| | Soup Test (2 hrs) | | Oil Test |
|---|---|---|---|
| Ex. | Weight Gain | Visual | (24 hours) Visual |
| 9 | 46% | 0% | creases |
| 10 | 38% | 0+% | 0% |
| C12 | 193% | 100% | 0% |
| C13 | 160% | 75–100% | 0% |

The data in Table 6 show that when tested only 2 hours after treatment, the mixtures containing predominately monofluoroalkyl phosphate ester (Examples 9 and 10) outperformed the mixtures containing predominately difluoroalkyl carboxylate (Comparative Examples C12 and C13) in microwave soup holdout.

Examples 11–22

Examples 11–22 in Table 7 show the evaluation of various fluoroaliphatic monoesters which were synthesized from fluoroaliphatic alcohols using essentially the same synthetic procedure as described in Example 1. After monoester formation was complete, the diisopropyl ether solution of the fluorochemical was washed with an equal volume of 2N hydrochloric acid. The organic phase was washed an additional two times with an equivalent volume of 2N hydrochloric acid before being poured in excess toluene which caused precipitation of the fluorochemical product. The fluorochemical was isolated and dried. Following preparation of the fluoroaliphatic diprotonic acid, partial or full neutralization was achieved (except for Example 12, which was unneutralized) using the appropriate stoichiometric amount of LiOH, ammonia, or the appropriate amine to give the salt shown in Table 7. Diluted Nalco™ 7607 was added in an amount sufficient to give 0.4% SOF, and diluted Hercon™ 76 was added in amount sufficient to give 0.5% SOF. For the Soup and Oil Tests, paper was formed and treated as described in Example 1. Curing was done using a Johnke™ Drum Dryer at 250° F., down to a residual moisture content of 10–15% by weight. Test results are summarized in Table 8.

TABLE 7

| Ex. | % SOF | Fluorochemical Evaluated |
|---|---|---|
| 11 | 0.17 | $C_8F_{17}SO_2N(C_2H_5)C_2H_4OP(O)(OH)(O^-)H_4N^+$ |
| 12 | 0.20 | $C_8F_{17}SO_2N(C_2H_5)C_2H_4OP(O)(OH)_2$ |
| 13 | 0.20 | $C_8F_{17}SO_2N(C_2H_5)C_2H_4OP(O)(OH)(O^-)H_2N^+(C_2H_4OH)_2$ |
| 14 | 0.20 | $C_8F_{17}SO_2N(C_2H_5)C_2H_4OP(O)(OH)(O^-)Li^+$ |
| 15 | 0.20 | $C_8F_{17}SO_2N(CH_3)C_2H_4OP(O)(O^-)_2[H_2N^+(C_2H_4OH)_2]_2$ |
| 16 | 0.20 | $C_8F_{17}SO_2N(C_4H_9)C_2H_4OP(O)(OH)(O^-)H_2N^+(C_2H_4OH)_2$ |
| 17 | 0.20 | $C_{10}H_{21}SO_2N(C_2H_5)C_2H_4OP(O)(OH)(O^-)H_2N^+(C_2H_4OH)_2$ |
| 18 | 0.20 | $C_6F_{13}SO_2N(C_2H_5)C_2H_4OP(O)(OH)(O^-)H_2N^+(C_2H_4OH)_2$ |
| 19 | 0.30 | $C_4F_9SO_2N(C_2H_5)C_2H_4OP(O)(OH)(O^-)H_2N^+(C_2H_4OH)_2$ |
| 20 | 1.00 | $C_4F_9SO_2N(C_2H_5)C_2H_4OP(O)(OH)(O^-)H_2N^+(C_2H_4OH)_2$ |
| 21 | 0.20 | $(C_4F_9)_2NC_2F_4SO_2N(CH_3)C_2H_4OP(O)(O^-)_2[H_2N^+(C_2H_4OH)_2]_2$ |
| 22 | 0.20 | $C_8F_{17}CH_2CH_2OP(O)(OH)(O^-)H_4N^+$ |

TABLE 8

| | Soup Test | | | Oil Test | |
|---|---|---|---|---|---|
| Ex. | Tested after: | Weight gain | Visual | Tested after: | Visual |
| 11 | 24 hr | 49% | 0% | 24 hr | 0% |
| 12 | 24 hr | 43% | 0% | 24 hr | 0% |
| 13 | 24 hr | 51% | 0% | 24 hr | 0% |
| 14 | 24 hr | 43% | 0% | 24 hr | 0% |
| 15 | 24 hr | 32% | 0% | 24 hr | 50–75% |
| 16 | 24 hr | 177% | 63% | 24 hr | 0% |
| 17 | 24 hr | 90% | 0% | 24 hr | 0% |
| 18 | 24 hr | 125% | 0–25% | 24 hr | 0–25% |
| 19 | 48 hr | 128% | 25–50% | 48 hr | 100% |
| 20 | 48 hr | — | 100% | 48 hr | 0% |
| 21 | 4 hr | — | 100% | 4 hr | 0% |
| 22 | 22 hr | 53% | 0% | 24 hr | 100% |

Soup and Oil Test results, presented in Table 8, show that fluoroaliphatic sulfonamide-derived monophosphate esters with $C_6$–$C_{10}$ perfluoroalkyl chain length, $C_1$–$C_4$ alkyl substitution on the sulfonamide nitrogen, and having a variety of cationic counterions (Examples 11–18) performed well as treatments according to the Soup and Oil Test results. Significant branching in the perfluoroalkyl chain (Example 21) or shortening of this chain to $C_4$ (Examples 19 and 20) led to poorer overall test results. The fluoroaliphatic monophosphate ester without the sulfonamide linkage (Example 22) performed well in the Soup Test but poorly in the Oil Test.

Example 23

In Example 23, a composition containing the fluoroalkyl monophosphate ester was prepared and used to treat paper as described in Example 1, except that the paper was made using Ponderosa Group pulp and the wet handsheet made on the Williams™ Sheet Mold was allowed to dry at room temperature (no bake cycle). The Soup Test was run 24 hours and 1 week after commencement of drying, and the Oil Test was run after 24 hours only. The composition of Example 23 is summarized in Table 9, and the test results are summarized in Table 10.

Comparative Examples C14–C16

In Comparative Example C14, Scotchban™ Brand Paper Protector FC-807 was substituted for the fluoroalkyl monophosphate ester of Example 23, and the level of Hercon™ 76 was raised from 0.5% to 1.0% SOF. In comparative Examples C15 and C16, Lodyne™ P201E and Zonyl™ RP, a difluoroalkyl phosphate available from dupont, were respectively substituted for the fluoroalkyl monophosphate ester of Example 23, while maintaining the level of Hercon™ 76 at 0.5% SOF. The compositions are summarized in Table 9, and the test results are summarized in Table 10.

Comparative Example C17

In Comparative Example C17, the fluoroalkyl monophosphate ester of Example 23 was omitted while maintaining the level of Hercon™ 76 at 0.5% SOF. The composition is summarized in Table 9, and the test results are summarized in Table 10.

TABLE 9

| Ex. | Nalco 7607 % SOF | Hercon 76 % SOF | Ester % SOF |
|---|---|---|---|
| 23 | 0.4 | 0.5 | 0.2 |
| C14 | 0.4 | 1.0 | 0.2 |
| C15 | 0.4 | 0.5 | 0.2 |
| C16 | 0.4 | 0.5 | 0.2 |
| C17 | 0.4 | 0.5 | 0 |

TABLE 10

| | Soup Test | | Oil Test |
|---|---|---|---|
| Ex. | 24 Hours - Visual | 1 Week - Visual | 24 Hours - Visual |
| 23 | 0% | 0% | 0% |
| C14 | 100% | 100% | 0% |
| C15 | 100% | 100% | 0–5% |
| C16 | 100% | 75% | 0% |
| C17 | 25–50% | 0–10% | 100% |

The data in Table 10 show that the fluoroalkyl monophosphate ester of Example 23 had excellent Soup Test and Oil Test result even when no heat cycle was employed, i.e. the treatment was allowed to cure at room temperature. In contrast, cured under the same ambient conditions, the fluorochemical paper treatments of Comparative Examples C14–C16 all had poor Soup Test results, and the alkyl ketene dimer (Hercon™ 76) used alone (Comparative Example C17) had poor Oil Test results.

Various modifications and alterations of this invention will be apparent to those skilled in the art without departing from the scope and spirit of this invention and this invention should not be restricted to that set forth herein for illustrative purposes.

What is claimed is:

1. A composition, comprising:

an alkyl ketene dimer; and a fluoroaliphatic radical-containing phosphate ester composition comprising at least 70% of a phosphate monoester $R_f$—Q—OP (O) ($O^-M^+$) ($O^-M^+$), wherein $R_f$ is a fluoroaliphatic radical, Q is a divalent organic linking group comprising a sulfonamido group, and each $M^+$is independently a monofunctional cation.

2. The composition of claim 1, wherein said phosphate ester composition comprises greater than 90% of said monoester.

3. The composition of claim 1, wherein Q is—$SO_2N(R)R'$—, R is selected from the group consisting of methyl, ethyl, propyl, or butyl groups, and R' is alkylene.

4. The composition of claim 3, wherein R is ethyl.

5. The composition of claim 3, wherein R' is ethylene.

6. The composition of claim 1, wherein $R_f$ is $C_nF_{2n+1}$, where n is from 3 to 12.

7. The composition of claim 6, wherein n is from 6 to 10.

8. The composition of claim 1, wherein $R_f$ is a straight chain.

9. The composition of claim 1, wherein said monoester is $C_8F_{17}SO_2N(C_2H_5)CH_2CH_2OP(O)(O^-M^+)(O^-M^+)$.

10. The composition of claim 1, wherein said alkyl ketene dimer is

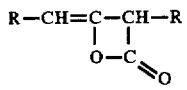

wherein each R is independently a straight or branched alkyl or alkylene group containing from 6 to 23 carbon atoms.

11. The composition of claim 1, wherein said phosphate monoester has the formula $R_f$—Q—OP(O) (OH) ($O^-M^+$), wherein $R_f$ is a fluoroaliphatic radical, Q is a divalent organic linking group comprising a sulfonamido group, and $M^+$is a monofunctional cation.

12. The composition of claim 11, wherein $M^+$is selected from the group consisting of ammonium and substituted ammonium cations.

13. The composition of claim 12, wherein $M^+$is $H_2N^+(C_2H_4OH)_2$.

14. The composition of claim 1, further comprising a cationic retention aid.

15. The composition of claim 1, wherein said composition is aqueous.

16. The composition of claim 1, wherein the ratio by weight of said alkyl ketene dimer to said phosphate ester composition is within the range of about 3:1 to about 6:1.

17. In combination with a cellulosic substrate, a composition, comprising:

an alkyl ketene dimer; and one or more fluoroaliphatic radical-containing phosphate esters, said one or more fluoroaliphatic radical-containing phosphate esters including at least 70% phosphate monoester $R_f$—Q—OP(O) ($O^-M^+$) ($O^-M^+$), wherein $R_f$ is a fluoroaliphatic radical, Q is a divalent organic linking group comprising a sulfonamido group, and each $M^+$is independently a monofunctional cation.

18. The combination of claim 17, wherein the amount of said one or more fluoroaliphatic radical-containing phosphate esters on said cellulosic substrate is within the range of about 0.2% to about 0.5% by weight.

19. The combination of claim 17, wherein said cellulosic substrate has from about 10% to about 15% moisture content.

20. The combination of claim 17, wherein said cellulosic substrate is paper.

21. An aqueous composition, comprising:

an alkyl ketene dimer of the structure

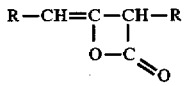

wherein each R is independently a straight or branched alkyl or alkylene group containing from 6 to 23 carbon atoms; and a mixture of fluoroaliphatic radical-containing phosphate esters comprising at least 70% of a phosphate monoester $R_f—SO_2N(R)R'—OP(O)(OH)(O^-M^+)$, wherein $R_f$ is a fluoroaliphatic radical, $M^+$ is a monofunctional cation, R is methyl, ethyl, propyl, or butyl, and R' is alkylene.

* * * * *